US005664882A

United States Patent [19]

Green et al.

[11] Patent Number: 5,664,882

[45] Date of Patent: Sep. 9, 1997

[54] SYSTEM FOR CONCURRENTLY REMEDIATING CONTAMINATED SOIL AND PRODUCING HOT MIX ASPHALT

[75] Inventors: Andrew W. Green, Cedar Rapids; Joseph E. Musil, Ely, both of Iowa

[73] Assignee: Cedarapids, Inc., Cedar Rapids, Iowa

[21] Appl. No.: 627,368

[22] Filed: Apr. 4, 1996

[51] Int. Cl.[6] ..... B28C 5/46

[52] U.S. Cl. ..... 366/25; 34/137; 432/110; 432/111; 432/118

[58] Field of Search ..... 366/7, 22–25, 366/233; 432/105, 106, 108, 110, 111, 115, 117, 118; 34/135, 136, 137

[56] References Cited

U.S. PATENT DOCUMENTS

| | | | |
|---|---|---|---|
| 1,836,754 | 12/1931 | Hepburn | 366/25 |
| 4,787,938 | 11/1988 | Hawkins | 366/7 X |
| 4,892,411 | 1/1990 | Elliott et al. | 432/111 X |
| 4,913,552 | 4/1990 | Bracegirdle | 366/25 X |
| 4,919,538 | 4/1990 | Swisher, Jr. | 366/25 X |
| 4,948,261 | 8/1990 | Marconnet | 366/25 |
| 4,954,995 | 9/1990 | Marconnet | 366/25 X |
| 4,955,722 | 9/1990 | Marconnet | 366/25 |
| 5,052,809 | 10/1991 | Young | 34/137 X |
| 5,054,931 | 10/1991 | Farnham et al. | 366/25 |
| 5,129,334 | 7/1992 | Mize | 432/106 X |
| 5,240,412 | 8/1993 | Mendenhall | 432/106 X |
| 5,273,355 | 12/1993 | May et al. | 432/106 X |
| 5,302,118 | 4/1994 | Renegar et al. | 432/106 X |
| 5,378,059 | 1/1995 | Brock . | |
| 5,393,501 | 2/1995 | Clawson et al. | 432/105 X |
| 5,470,146 | 11/1995 | Hawkins . | |
| 5,538,340 | 7/1996 | Brashears | 366/25 |
| 5,558,432 | 9/1996 | Swisher, Jr. | 366/25 |

*Primary Examiner*—Charles E. Cooley
*Attorney, Agent, or Firm*—Donald R. Schoonover

[57] ABSTRACT

A system for concurrently remediating contaminated soil and producing hot mix asphalt includes a single inclined rotary drum; a burner assembly with a burner head spaced intermediately within the drum and oriented to direct a flame and hot gas stream upstream therefrom; a secondary air tube for providing atmospheric air to the burner head for supporting combustion; a drying zone with veiling flights upstream from the burner head for receiving, drying and heating virgin aggregate; a combustion zone with combustion flights downstream from the drying zone and upstream from the burner head for receiving and remediating contaminated soil by heat transfer from the virgin aggregate, the flame and the hot gas stream and for oxidizing volatile contaminants vaporized from the contaminated soil; an isolated mixing zone for receiving various materials including the virgin aggregate, the remediated soil, recycle asphalt, and certain constituents for producing hot mix asphalt therein from thermal energy contained within those materials. A method for concurrently remediating soil and producing hot mix asphalt in a single rotary drum consistent with the foregoing is provided.

9 Claims, 4 Drawing Sheets

SYSTEM FOR CONCURRENTLY REMEDIATING CONTAMINATED SOIL AND PRODUCING HOT MIX ASPHALT

BACKGROUND OF THE INVENTION

1. Field of the Invention

The present invention relates generally to soil remediation equipment and, particularly, without limitation, to such equipment utilizing a combustion chamber in a rotating drum.

2. Description of the Related Art

Remediation of contaminated soil is, and will continue to be for the foreseeable future, a large and growing industry. For example, soil containing hydrocarbons due to service station ground leakage must be cleaned or removed before the property can be transferred.

The generally applied method of remediating contaminated soil is to heat the soil with a large combustion heater to a sufficiently elevated temperature, such as approximately 400°–700° F., in an inclined rotating drum, that gravitationally urges the soil continuously therethrough. The elevated temperature causes the contaminants—typically hydrocarbons, both short chain and long chain—to be released from the soil by vaporization.

The vapors, containing combustion products from the burner used to elevate the soil temperature and the contaminants, are usually directed, after filtering, into an afterburner. The afterburner generally comprises a second large burner that, in conjunction with the combustion properties of the contaminants, further elevate the temperature of the vapors in order to break down and oxidize contaminants remaining in the vapors. Short-chain or light hydrocarbons, such as those arising from service station leakage, vaporize in the range of approximately 300°–500 ° F. and require afterburning at approximately 1600° F. Unfortunately, soil that has been de-contaminated generally must be discarded. Because of the high temperatures involved, substantially all nutrients in the soil are generally destroyed during remediation and, therefore, the soil is generally not conducive for growing vegetation.

For recycling asphalt materials for the production of hot mix asphalt, excessive heating of asphalt compositions may result in a substantial air pollution control problem, known as "blue-smoke", caused when hydrocarbon constituents of asphalt are driven off and released into the atmosphere. The presence of asphalt in the recycle material creates essentially the same problems in asphalt production as does the presence of liquid asphalt. The volatile components of the asphalt are released upon exposure to high temperatures and may be carried in the exhaust gases to the air pollution control equipment, typically a baghouse. Within the baghouse, the blue-smoke or tiny particles of asphalt will condense on the filter bags reducing their efficiency and presenting a serious fire hazard. The useful life of the fabric filter used in the baghouse is also reduced when contaminated with asphalt.

Various systems have been developed for using recycle asphalt materials in the production of hot mix asphalt. For example, U.S. Pat. No. 5,470,146 provides a hot mix asphalt plant wherein a drum mixer isolates liquid asphalt and recycle asphalt materials, if used, from the radiant heat flux of a burner flame and from a hot gas stream produced by the burner to thereby reduce air pollution emission, including reducing the amount of hydrocarbons entrained in the hot gas stream and carried to the air pollution control equipment.

Fortunately, some of the volatile contaminants of contaminated soil are more readily vaporizable and oxidizable than the asphalt constituents of liquid asphalt and recycle asphalt materials. As a result and in regard to air pollution control equipment, the precautions for remediating soil contaminated with highly volatile contaminants, such as gasoline, are not as burdensome as those for preventing blue-smoke production from asphaltic constituents.

One attempt to dispose of remediated soil is disclosed in U.S. Pat. No. 5,378,059 wherein remediated soil is mixed with other constituents for producing hot mix asphalt for asphalt paving and the like. The '059 apparatus includes a rotating drum having a lower end thereof mounted in a fixed sleeve such that an annular chamber is formed between the rotating drum and the fixed sleeve. Contaminated soil, recycle asphalt material and various ingredients are introduced into the annular chamber formed by the fixed sleeve to be combined with heated aggregate also introduced into the annular chamber from an interior chamber of the rotating drum. Performance of the '059 apparatus is dependent upon the ability of a plurality of mixing blades, mounted on the outer surface of the rotating drum and spaced within the annular chamber formed by the fixed sleeve, to reliably mix the heated aggregate with the contaminated soil, recycle asphalt and other ingredients while simultaneously urging all of those materials up the incline of the fixed sleeve. All materials being conveyed through the annular chamber formed by the fixed sleeve are heated by contact with the heated aggregate, by conductive heat transfer from the mixing blades, and by radiant heat transfer from the outer peripheral surface of the rotating drum.

What is needed is a system for concurrently remediating contaminated soil and producing hot mix asphalt wherein virgin aggregate is dried and heated, contaminated soil is remediated, and hot mix asphalt is produced from the remediated soil, recycle asphalt products, and customary constituents in an isolated mixing zone wherein available thermal energy for such hot mix asphalt production is provided substantially only by thermal energy contained within the materials introduced into the mixing zone—all within a single rotating drum.

SUMMARY OF THE INVENTION

An improved system is provided for concurrently remediating contaminated soil and producing hot mix asphalt. The system includes a single inclined drum having an input end, a discharge end, and a cavity extending between said input end and said discharge end. The drum is rotatably driven about a substantially horizontal axis and has stationary upstream and downstream portions for respectively and rotatably receiving the input end and the discharge end of the drum.

A burner assembly, extending within the cavity from the downstream portion, includes a burner head spaced generally intermediately between the input end and the discharge end. The burner bead is oriented such that a flame and hot gas stream therefrom are directed upstream from the burner head toward the input end. A secondary air tube is configured to provide atmospheric air to the burner head for supporting combustion.

A heating zone is spaced within the cavity upstream from the burner head, and a mixing zone is spaced within the cavity downstream from the burner head. Also, aggregate input means are provided for introducing the virgin aggregate into the heating zone near the input end of the drum, soil input means are provided for introducing contaminated soil into the heating zone; and asphalt input means are provided for introducing certain of the various constituents into the mixing zone for producing hot mix asphalt.

The heating zone includes a drying zone spaced adjacently to, and extending axially inwardly from, the input end wherein a plurality of veiling flights are configured to operatively create a falling curtain of the virgin aggregate as the virgin aggregate is lifted and dropped by the veiling flights. The heating zone also includes a combustion zone extending from the drying zone to the burner head wherein a plurality of low-profile flights are configured to operatively maintain materials being processed through the combustion zone near lower extremities of the combustion zone.

The contaminated soil is introduced into the combustion zone such that substantially all volatile contaminants and moisture being vaporized from the contaminated soil are substantially vaporized prior to exiting of the soil from the combustion zone. Also, the contaminated soil is introduced into the combustion zone such that substantially all volatile contaminants being vaporized from the contaminated soil are substantially oxidized within the combustion zone. The contaminated soil is introduced into the combustion zone on top of the virgin aggregate being gravitationally urged through the combustion zone. The volatile contaminants vaporized from the contaminated soil are so vaporized by conductive heat transfer from the virgin aggregate, by radiative heat transfer from the flame, and by convective heat transfer from the hot gas stream.

The mixing zone is isolated by, among other things, the discharge end of the drum being sealingly received by the stationary downstream portion of the drum such that gas flow through the mixing zone is substantially eliminated, by the secondary air tube being spaced apart from the burner assembly and being substantially longitudinally coextensive with the burner assembly within the cavity, and by a cowling extending longitudinally inwardly and radially outwardly from the secondary air tube. In addition, the mixing zone and materials being processed in the mixing zone are isolated from substantially all heat transfer thereto, except for heat transfer arising from thermal energy contained internally within those materials as those materials are introduced into the mixing zone.

The system also includes recycle input means for introducing recycle asphalt material into the mixing zone for mixing with the various constituents, including soil remediated by the system, for producing hot mix asphalt.

The present invention includes a method for concurrently remediating soil and producing hot mix asphalt in a single rotary drum.

PRINCIPAL OBJECTS AND ADVANTAGES OF THE INVENTION

The principal objects and advantages of the present invention include: providing a system for concurrently remediating contaminated soil and producing hot mix asphalt; providing such a system wherein soil is remediated and hot mix asphalt is concurrently produced within a single rotating drum; providing such a system wherein soil remediated therein is used as an ingredient of the hot mix asphalt produced therein; providing such a system wherein hot mix asphalt is produced in an isolated mixing zone; providing such a system wherein contaminants are vaporized from contaminated soil by conductive heat transfer from heated virgin aggregate therein, radiative heat transfer from a flame of a burner thereof, and convective heat transfer from a hot gas stream from the burner; and generally providing such a system that is reliable in performance and is particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
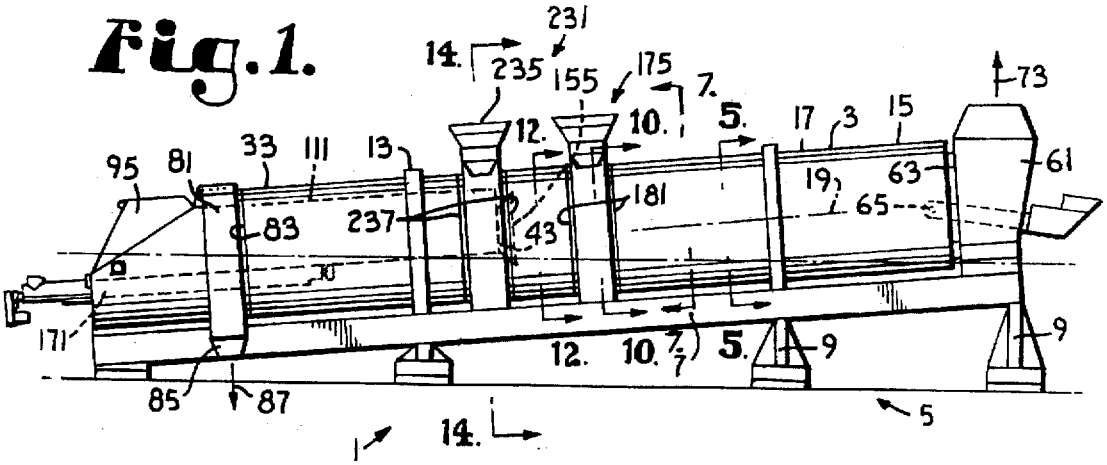
FIG. 1 is a side elevational view of a system for concurrently remediating contaminated soil and producing hot mix asphalt, showing among other things a drum and a contaminated soil input feed assembly and a recycle asphalt input feed assembly, according to the present invention.

The reference numeral 1 generally refers to a system for concurrently remediating contaminated soil and producing hot mix asphalt in accordance with the present invention, as shown in FIGS. 1 through 15. The system 1 generally includes a cylindrically shaped rotary drum 3 supported on frame means 5. The frame means 5 generally comprises a pair of spaced apart, parallel beams 7, inclined from a horizontal orientation and supported by vertical legs 9. Mounted on the parallel beams 7 are a plurality of motor driven rollers 11 that supportingly receive trunnion rings 13 secured to an exterior surface 15 of an exterior wall 17 of the rotary drum 3, as shown in FIG. 1. Rotation of the drive rollers 11, as engaged with the trunnion rings 13, causes the rotary drum 3 to be rotated about an axis 19, as indicated by numeral 21 in FIGS. 5, 10, 12 and 14.

The rotary drum 3 has an input end 31 and a discharge end 33 which, in conjunction with the exterior wall 17, form a cavity 35 extending within the wall 17 and generally from the input end 31 to the discharge end 33 of the drum 3. The cavity 35 includes a heating zone 41 extending from adjacent to the input end 31 of the rotary drum 3 to near a burner head 43 of an elongate burner assembly 45. The heating zone 41 is spaced upstream from the burner head 43, as measured by the direction of travel of materials being processed through the system 1, as indicated by the arrow designated by the numeral 47 in FIG. 13 and as hereinafter described in more detail. The cavity 35 also includes a mixing zone 49 extending from adjacent to the discharge end 33 of the rotary drum 3 to the vicinity of, but short of, the burner head 43. The mixing zone 49 is spaced downstream 47 from the burner head 43, as hereinafter described in more detail.

Located at the input end 31 of the drum 3 is a fixed and substantially closed input housing 61 having a circular opening to receive the input end 31 of the drum 3 and a bearing seal 63 to permit rotation of the drum 3 relative to the input housing 61. A material conveyor 65, penetrating the input housing 61 and extending into the input end 31 of the rotary drum 3, is adapted to direct virgin aggregate received from a storage hopper or stockpile, as indicated by the arrow designated by the numeral 67 in FIG. 13, into the cavity 35 of the rotary drum 3, as indicated by the arrow designated by the numeral 69. An upper end or exhaust duct 71 of the input housing 61 is adapted to be connected to conventional air pollution control equipment, such as a centrifugal or cyclone separator or baghouse or a combination of the two, to remove particulates from gases exhausted from the system 1, as indicated by the arrow designated by the numeral 73.

The longitudinal axis 19, about which the rotary drum 3 is rotated, is inclined such that the input end 31 is elevated above the discharge end 33. The rotary drum 3 is sufficiently inclined whereby materials being processed through the cavity 35 of the rotary drum 3 are gravitationally urged downstream 47 toward the discharge end 33 of the rotary drum 3.

Located at the discharge end 33 of the drum 3 is a fixed discharge housing 81. The discharge housing 81 includes a circular opening to receive the discharge end 33 of the rotary drum 3 and a bearing seal 83 adapted to permit rotation of the drum 3 relative to the discharge housing 81. A discharge chute 85 situated at a lower portion of the discharge housing 81 is adapted to discharge and direct materials processed by the rotary drum 3 from the cavity 35 to a material conveyor for delivery of those materials to a storage bin or transporting vehicle, as indicated by the arrow designated by the numeral 87 in FIG. 13.

Figure 3:
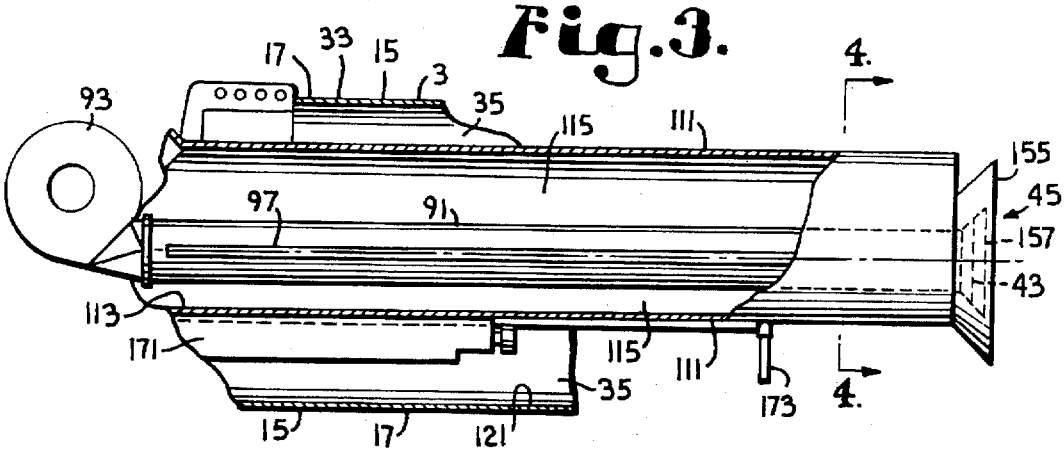
FIG. 3 is an enlarged and fragmentary, partially cross-sectional view of the system for concurrently remediating contaminated soil and producing hot mix asphalt, showing a burner assembly and a secondary air tube assembly with portions cut away to reveal details thereof.
Figure 7:
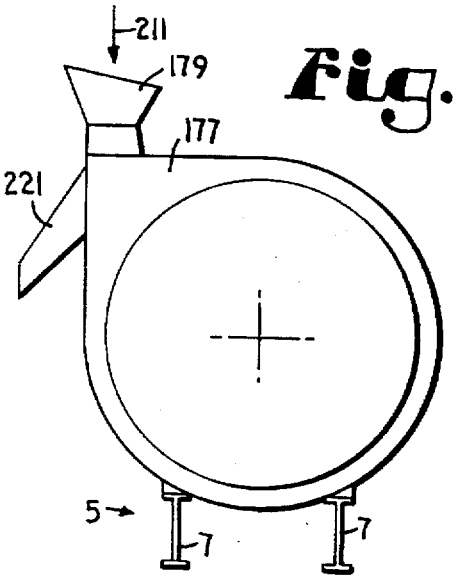
FIG. 7 is an enlarged and fragmentary, schematic representation of one of the input feed assemblies of the system for concurrently remediating contaminated soil and producing hot mix asphalt, taken along line 7—7 in FIG. 1.
Figure 2:
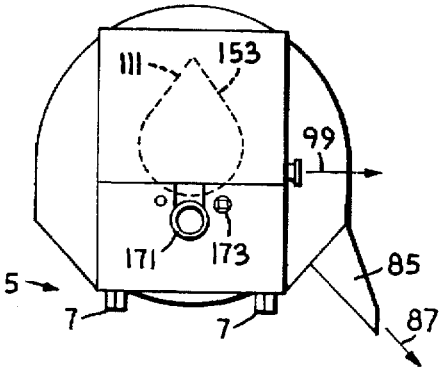
FIG. 2 is an enlarged, end elevational view of the system for concurrently remediating contaminated soil and producing hot mix asphalt.

The burner assembly 45 extends substantially into the cavity 35 and includes a primary air tube 91 having the burner head 43 on an innermost end thereof. The burner assembly 45 is supported by the discharge housing 81. The primary air tube 91 is connected to a blower 93 housed in a blower housing 95 situated near the discharge end 33 of the drum 3, as shown in FIG. 1. The blower housing 95, among other things, tends to reduce noise levels which would otherwise emanate from the blower 95 to the surrounding area. The blower 93 is adapted to force air through the primary air tube 91 to the burner head 43. Disposed generally within the primary air tube 81 is fuel piping 97, as shown in FIG. 3, connected to an exterior fuel supply, such as a natural gas line, as indicated by the arrow designated by the numeral 99 in FIG. 2. Air from the blower 93 and fuel from the fuel piping 97 are discharged through the burner head 43 to maintain a flame 101 directed longitudinally into the cavity 35 and upstream from the burner head 43 toward the input end 31 of the drum 3.

Figure 4:
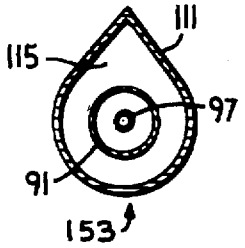
FIG. 4 is an enlarged and fragmentary, cross-sectional view of the burner assembly and the secondary air tube assembly of the system for concurrently remediating contaminated soil and producing hot mix asphalt, taken along line 4—4 of FIG. 3.
Figure 10:
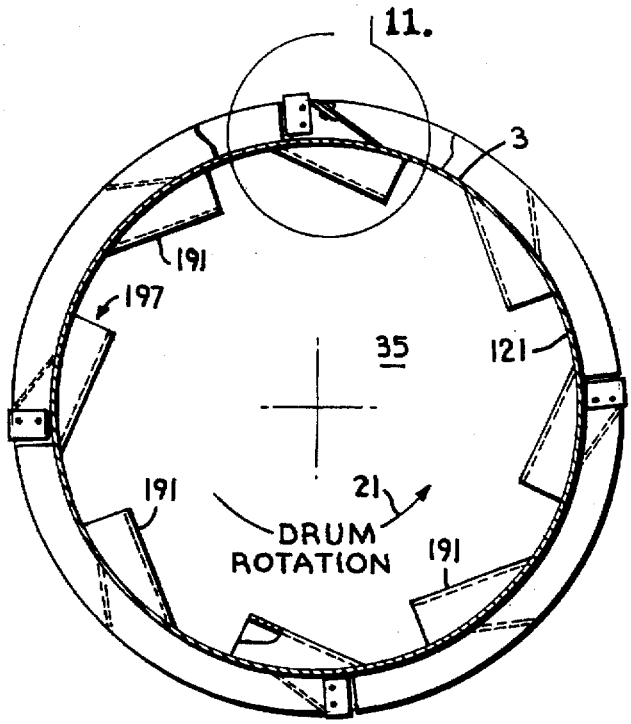
FIG. 10 is a further enlarged and fragmentary, schematic representation of a cross-section of the system for concurrently remediating contaminated soil and producing hot mix asphalt, showing the contaminated soil input feed assembly, taken along line 10—10 in FIG. 1.

An elongate secondary air tube 111, supported by the discharge housing 81 at a proximal end 113 thereof, also extends into the cavity 35 substantially coextensive with the burner assembly 45. The secondary air tube 111 surrounds, and is spaced apart from, the primary air tube 91 and the burner head 43, as shown in FIGS. 3 and 4. The proximal end 113 is adapted to establish atmospheric communication whereby secondary air can be readily drawn through an annular region 115 between the secondary air tube 111 and the primary air tube 91 to the burner head 43 to support combustion of the flame 101. The secondary air tube 111 and the primary air tube 91 extend into the cavity 35 approximately one-third of the length of the drum 3; however, this relative dimension may be varied as necessary or desired. The secondary air tube 111 provides additional functions as hereinafter described.

At different regions throughout the interior of the drum 3 and attached to an interior surface 121 of the wall 17 are various types of flightings or paddles for the alternative purposes of lifting, mixing, tumbling, stirring, etc., of material being processed within the cavity 35. The actions of the various flightings are known to those skilled in the art and, accordingly, the flightings now discussed describe workable embodiments but are not intended to be exhaustive of the various combinations which could be utilized with the present invention.

Figure 5:
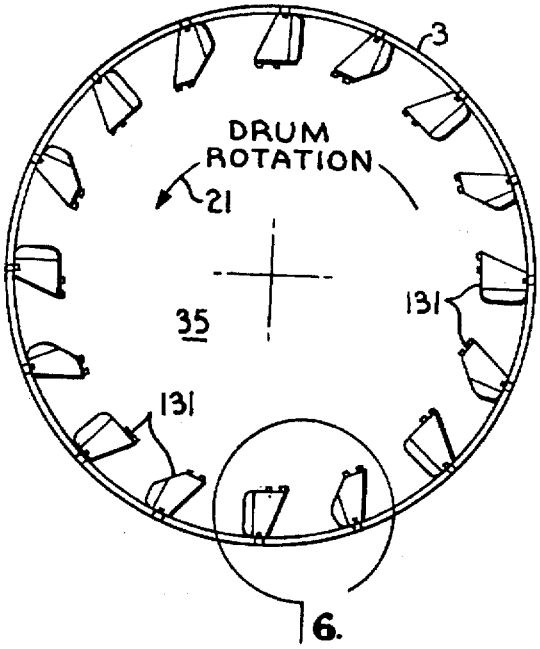
FIG. 5 is a further enlarged and fragmentary, cross-sectional view of bucket flights in a drying zone of the system for concurrently remediating contaminated soil and producing hot mix asphalt, taken along line 5—5 in FIG. 1.
Figure 6:
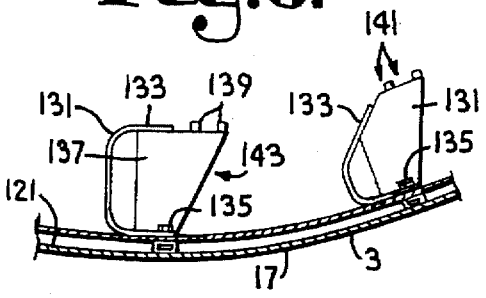
FIG. 6 is a still further enlarged and fragmentary, cross-sectional view of the bucket flights of the system for concurrently remediating contaminated soil and producing hot mix asphalt, taken from detail 6 in FIG. 5.
Figure 8:
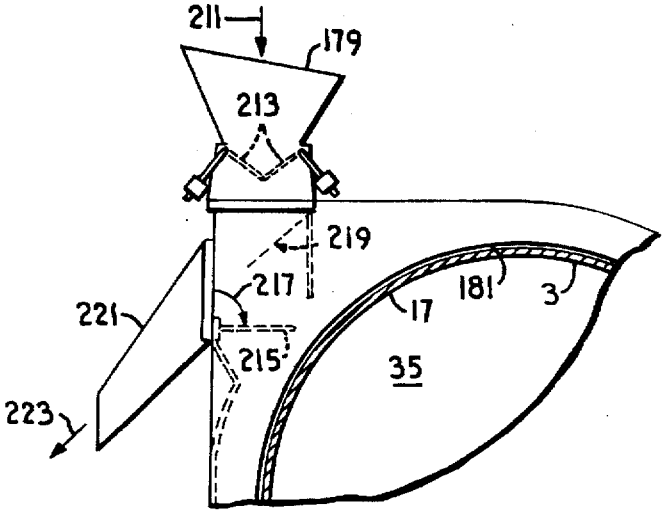
FIG. 8 is a further enlarged and fragmentary view of one of the input feed assemblies of the system for concurrently remediating soil and producing hot mix asphalt.
Figure 9:
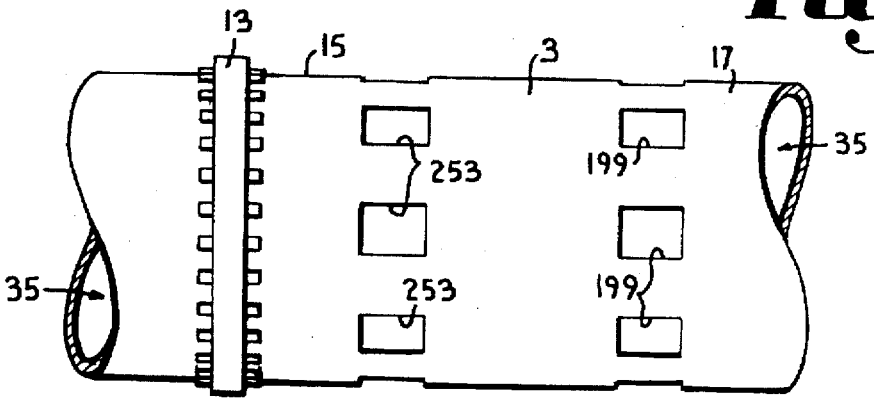
FIG. 9 is an enlarged and fragmentary, side elevational view of the system for concurrently remediating contaminated soil and producing hot mix asphalt, showing the drum without either of the contaminated soil and recycle asphalt input feed assemblies.
Figure 13:
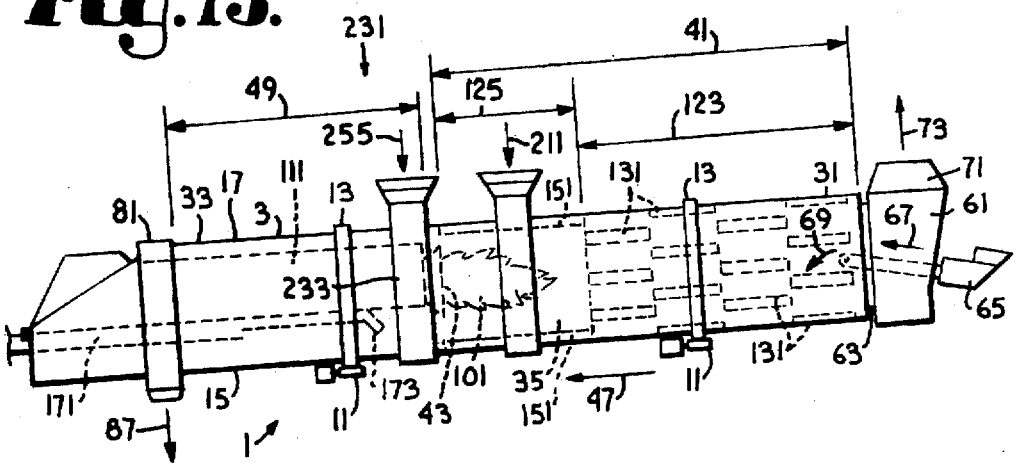
FIG. 13 is an schematic representation of the system for concurrently remediating contaminated soil and producing hot mix asphalt, similar to the view shown in FIG. 1 but including details of flightings and drying, combustion and mixing zones thereof.

The heating zone 41 comprises a drying zone 123 and a combustion zone 125. The drying zone 123 extends from adjacent to the input end 31 and continues downstream to a point beyond the reach of the flame 101 from the burner head 43, as shown in the schematic representation of FIG. 13; the combustion zone 125 extends from the drying zone 123 to the burner head 43. In the drying zone 123, the flighting is generally configured as open-topped bucket flights 131, as shown in FIGS. 5 and 6. The bucket flights 131 are arranged longitudinally and generally parallel with the axis 19 of the drum 3. Generally, the bucket flights 131 are arranged in a plurality of sections spaced sequentially along the axis 19, with the spacings of the bucket flights 131 of each of the sections staggered relative to the spacings of the bucket flights 131 of adjacently spaced sections, as shown in FIG. 13 which shows four of such sections.

Each of the bucket flights 1315 has a bottom portion 133 supported by brackets 135 secured to the interior surface 121 of the wall 17 of the rotary drum 3. Spaced apart bucket side walls 137 are connected to the bottom portion 133. Mounted on outermost ends of the bucket side walls 137 are parallel bars 139 which form elongate openings 141 on the sides of the bucket flights 131.

As configured and arranged, virgin aggregate being gravitationally urged along the bottom of the drum 3 will be picked up by the bucket flights 131 as the drum 3 is rotated about the axis 19. As the bucket flights 13 1 are rotated upwardly, virgin aggregate falls through the elongate openings 141 formed by the parallel bars 139 mounted on the bucket side walls 137. As the bucket flights 131 are rotated further upwardly, virgin aggregate spills from an open top 143 of the bucket flights 131 with all of the virgin aggregate being discharged therefrom as the bucket flights 131 continue over the top of its arcuate displacement and descend back to the bottom of the drum 3 to repeat the cycle. In other words, the bucket flights 131 create curtains of falling virgin aggregate across the cavity 35 in the drying zone 123 by lifting and gradually dropping the virgin aggregate as rotation of the drum 3 causes the bucket flights 131 to be arcuately displaced across the upper reaches of the cavity 35.

Figure 12:
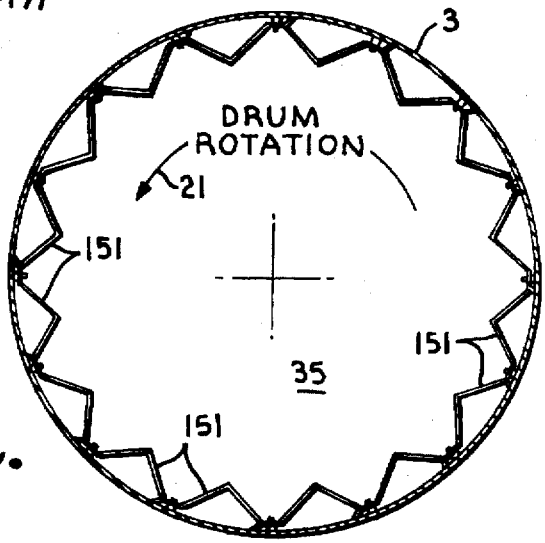
FIG. 12 is a further enlarged and fragmentary, schematic representation of a cross-sectional view of combustion flights of the system for concurrently remediating contaminated soil and producing hot mix asphalt, taken along line 12—12 in FIG. 1.

In the combustion zone 125, the flighting is configured as low-profile combustion flights 151, as shown in FIG. 12. As with the bucket flights 131, the combustion flights 151 are arranged longitudinally and generally parallel with the axis 19 of the drum 3. Instead of being lifted and veiled, however, material being processed by the combustion flights 151 is generally tumbled and mined and mixed across the bottom and along the lower sides of the wall 17 as the drum 3 is rotated.

If desired, slanted guide plates (not shown) may be fixed to the interior surface 121 of the drum 3 to direct toward or into the mixing zone 49, and expedite transfer of, material being gravitationally urged downstream 47 from the combustion zone 125.

As in the combustion zone 125, flighting in the mixing zone 49 is generally configured as low-profile flights arranged longitudinally and generally parallel with the axis 19 of the drum 3 such that material being processed in the mixing zone 49 is generally tumbled, mined and mixed instead of being lifted and veiled as in the drying zone 123. If desired, flighting in the mixing zone 49 may be similar to the combustion flights 151 of the combustion zone 125. However, as the temperatures in the mixing zone 49 are considerably reduced from those in the combustion zone 125 and as more thorough mixing of materials in the mixing zone 49 is generally required, other types of flighting, such as saw-tooth flights or other suitable flighting may be more suitable for the mixing zone 49 for most applications.

As hereinbefore described, the mixing zone 49 is situated downstream from the burner head 43, with upstream extremities of the mixing zone 49 being spaced downstream from the burner head 43 and downstream extremities of the mixing zone 49 being spaced adjacent to the discharge end 33 of the drum 3. Radially outward extremities of the mixing zone 49 are bounded by the wall 17 of the drum 3, and radially inward extremities of the mixing zone 49 are bounded by the secondary air tube 111. The low-profile flighting of the mixing zone 49 allows materials being processed in the mixing zone 49 to remain along the bottom and lower sides of the wall 17 as those materials are gravitationally urged toward the discharge chute 85. As the drum 3 rotates, the radially outward extremities of the mixing zone 49, namely the wall 17 adjacent to the mixing zone 49, is repetitiously cycled through a cooling process as it is rotatively elevated above the materials being processed in the mixing zone 49 and contacts the ambient atmosphere as it is arcuately displaced over and above the secondary air tube 111.

Also, as atmospheric air is drum through the secondary air tube 111 to support combustion at the burner head 43, the highest temperatures of the secondary air tube 111 in the mixing zone 49 are generally substantially lower than the temperatures of the materials being processed in the mixing zone 49. Thus, the radially inward extremities of the mixing zone 49, namely the secondary air tube 11, acts as a heat sink rather than as a heat source for the materials being processed in the mixing zone 49.

The secondary air tube 111 may be cylindrically shaped, having a longitudinal axis coincident with the longitudinal axis of the primary air tube 91 or, preferably, may have a teardrop-shaped cross-sectional form, as indicated by the arrow designated by the numeral 153 in FIG. 4. The teardrop form 153 provides enhanced structural integrity for the secondary air tube 111, particularly for the substantial extension of the fixed or stationary secondary air tube 111 completely through the rotating structure of the mixing zone 49. Further, the teardrop form 153 provides greater surface area to enhance the cooling effects provided by the temperature of the atmospheric air being drawn through the annular region 115 of the secondary air tube 111 to the burner head 43.

Preferably, a cortically shaped cowling 155 is spaced at the inner extremity of the teardrop form 153 to substantially reduce and perhaps entirely eliminate effects of radiant heat transfer from the flame 101 back toward the mixing zone 49, depending on the radially outward extent and axially upstream extent of the cowling 155 from the teardrop form 153, as shown in FIG. 3. In addition, the primary air tube 91 may have a cowling 157, which provides some shielding of the cowling 155 from the flame 101. Further, the bearing seal 83 substantially eliminates movement of air through the mixing zone 49, either toward or away from the combustion zone 155.

In other words, the cooperative configurations of the secondary air tube 111 including the cowling 155 and drawing of atmospheric air longitudinally through the annular region 115 of the secondary air tube 111, directing the flame 101 and corresponding hot gas steam upstream from the burner head 43 toward the input end 31 and away from the mixing zone 49, and eliminating air movement through the mixing zone 49 by use of the bearing seal 83 effectively isolate the mixing zone 49, with one exception, from substantially all heating effects of the hot gas stream and the flame 101, including those which could otherwise arise from direct contact with the hot gas stream and the flame 101 and those which could otherwise arise indirectly from the hot gas stream and the flame 101, including radiant, convective and conductive heating effects. The referred-to exception is thermal energy contained internally in materials transferred from the combustion zone 125 to the mixing zone 49. Of course, other constituents such as liquid asphalt introduced into the mixing zone 49 for producing hot mix asphalt, as hereinafter described, may internally and desirably contain controlled quantities of thermal energy not arising directly or indirectly from the hot gas stream of the flame 101.

More specifically, the mixing zone 49 and materials being processed in the mixing zone 49 are isolated from the flame 101 and the hot gas stream. Definition of the term "isolated" as applicable to the mixing zone 49 of the present invention includes not only the particular cooperating arrangement of various components of the system 1 but also includes the admission of desirable effects to the mixing zone 49 and to materials therein, such as internally contained thermal energy, and includes the inadmission of undesirable effects to the mixing zone 49 and to materials therein, such as air movement through the mixing zone 49 and further heating of materials in the mixing zone 49 from sources other than thermal energy contained internally within the materials in the mixing zone 49.

Due to the elimination of air movement through the mixing zone 49, any volatile components vaporized from the asphaltic components quickly condense within, and do not leave, the mixing zone 49 thereby avoiding burdening the pollution control equipment 73 or risking production of blue-smoke contamination.

A screw conveyor 171 is mounted generally beneath the secondary air tube 111 within the drum 3 and generally extends through the discharge housing 81. The screw conveyor 171 is connected to conventional equipment (not shown) for feeding binder material, mineral "fines" or reclaimed particulate matter from the baghouse 73 to the mixing zone 49. Positioned alongside the screw conveyor 171, and likewise extending through the discharge housing 81, is an asphalt injection tube 173. The asphalt injection tube 173 is also connected to conventional equipment (not shown) for spraying liquid asphalt in the mixing zone 49 of the drum 3 for producing hot mix asphalt.

Upstream from the burner head 43 is a contaminated soil input feed assembly 175 by which contaminated soil to be remediated may be introduced into the cavity 35. The contaminated soil input feed assembly 175 includes a collar 177 encircling the exterior wall 17 of the drum 3 and includes a feed hopper 179 providing access to the interior of the collar 177. Bearing seals 181 along the juncture between the collar 177 and the exterior surface 15 of the drum 3 permit rotation of the drum 3 within the encircling collar 177 while suppressing air movement to and from the cavity 35 through the contaminated soil input feed assembly 175.

Figure 11:
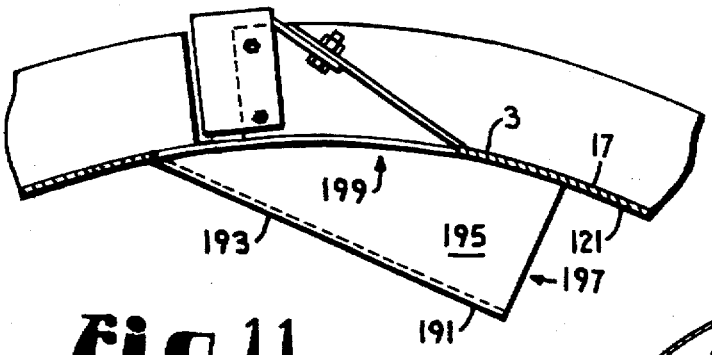
FIG. 11 is a still further enlarged and fragmentary, side elevational view of the system for concurrently remediating contaminated soil and producing hot mix asphalt, showing the contaminated soil input feed assembly in greater detail, taken from detail 11 in FIG. 10.

Secured to the inner surface 121 of the wall 17 of the drum 3 and projecting into the cavity 35 are a plurality of scoops 191 radially spaced around the drum 3. Each of the scoops 191 has a side wall 193 and a pair of opposing end walls 195 that cooperatively form a scoop opening 197, providing access from the scoops 191 to the cavity 35, as shown in FIG. 11. Also, a plurality of wall openings 199, one spaced beside each of the scoops 191, provide access from the collar 177 to the scoops 191. Thus, contaminated soil may be delivered by conveyor (not shown) to the feed hopper 179, as indicated by the arrow designated by the numeral 211 in FIG. 7, and subsequently introduced into the cavity 35 of the drum 3 through the scoops 191 rotating within the collar 177.

Valve means, such as a pair of co-acting weighted flapper valves 213, automatically respond to allow contaminated soil deposited into the feed hopper 179 to fall downwardly into the collar 177. After the contaminated soil passes from the feed hopper 179 to the collar 177, the valves 213 automatically return to their normally closed configuration to minimize entry of ambient air into the system 1. If necessary to take a sample or specimen of the contaminated soil being introduced through the contaminated soil input feed assembly 175, such as for calibration purposes, a chute door 215 may be opened, as indicated by the arrow designated by the numeral 217 in FIG. 8, and a diverter plate 219 may be oriented such that contaminated soil passing through the flapper valves 213 is diverted through a diverter chute 221, as indicated by the arrow designated by the numeral 223.

The scoops 191 open downwardly as the scoops 191 receive contaminated soil from the collar 177, depositing the contaminated soil near the wall 17 and onto the top of the heated virgin where the contaminated soil is desirably prevented from immediately mixing with the virgin aggregate being gravitationally urged through the combustion zone 125 and thereby preventing capture of some of the contaminants of the contaminated soil in a resultant contaminated soil/virgin aggregate mixture.

Being so deposited on top of the virgin aggregate, the contaminated soil is fully exposed to the hot gas stream and radiant heat flux from the flame 101. As the contaminated soil tumbles and turns across and near the top of the heated virgin aggregate as the drum 3 continues to rotate, volatile contaminants being vaporized from the contaminated soil are so vaporized by conductive heat transfer from the heated virgin aggregate, by radiative heat transfer from the radiant flame 101, and by convective heat transfer from the hot gas stream. As a result, substantially all of the contaminants which might otherwise upset the desired design mix of constituents for producing hot mix asphalt in the mixing zone 49 are removed from the contaminated soil and, further, the soil is substantially remediated. The volatilized contaminants are oxidized by the time 101 and the hot gas stream.

The contaminated soil input feed assembly 175 is spaced relative to the combustion zone 125 such that substantially all volatile contaminants contained in the contaminated soil introduced through the contaminated soil input feed assembly 175 have been vaporized from the contaminated soil before the contaminated soil exits from the combustion zone 125. Further, the contaminated soil input feed assembly 175 is spaced relative to the combustion zone 125 such that substantially all volatilized contaminants vaporized from the contaminated soil introduced through the contaminated soil input feed assembly 175 are oxidized within the combustion zone 125.

Downstream from the burner head 43 is a recycle asphalt input feed assembly 231 by which recycle asphalt material may be introduced into the cavity 35. The recycle asphalt input feed assembly 23 1 includes a stationary collar 233 encircling the wall 17 of the drum 3 and includes a feed hopper 235 providing access to the interior of the collar 233. Bearing seals 237 along the juncture between the collar 233 and the exterior surface 15 of the drum 3 permit rotation of the drum 3 within the encircling collar 233 while suppressing air movement to and from the cavity 35 through the recycle asphalt input feed assembly 231.

Figure 15:
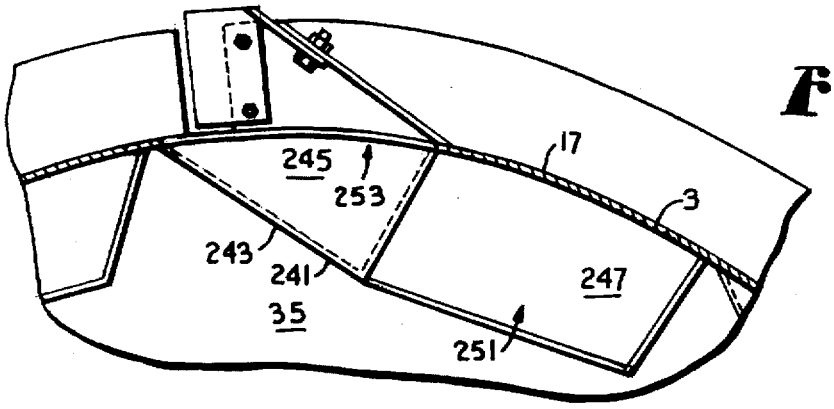
FIG. 15 is a still further enlarged and fragmentary, side elevational view of the system for concurrently remediating contaminated soil and producing hot mix asphalt, showing the recycle asphalt input feed assembly in greater detail, taken from detail 15 in FIG. 14, according to the present invention.

Secured to the inner surface 121 of the wall 17 of the drum 3 and projecting into the cavity 35 are a plurality of scoops 241 radially spaced around the drum 3. Each of the scoops 241 has a side wall 243 and two side walls 245 and 247 that, cooperatively with the side wall 243, form a scoop opening 251 providing access from the scoops 241 to the cavity 35, as shown in FIG. 15. The side walls 247, spaced upstream from the side walls 245, has a greater radial extent than the side walls 245 to provide a somewhat downstream thrust component to the recycle asphalt material as the recycle asphalt material empties into the mixing zone 49 from the scoops 241. Again, a plurality of wall openings 253, one spaced beside each of the scoops 241, provide access from the collar 233 to the scoops 241.

Recycle asphalt material may be delivered by conveyor (not shown) to the feed hopper 235, as indicated by the arrow designated by the numeral 255 in FIG. 13, and subsequently introduced into the cavity 35 of the drum 3 through the scoops 241 rotating within the collar 233. The recycle asphalt input feed assembly 231 includes valve means, chute door, diverter plate, diverter chute, etc., similar to those hereinbefore described for the contaminated soil input feed assembly 175.

Figure 14:
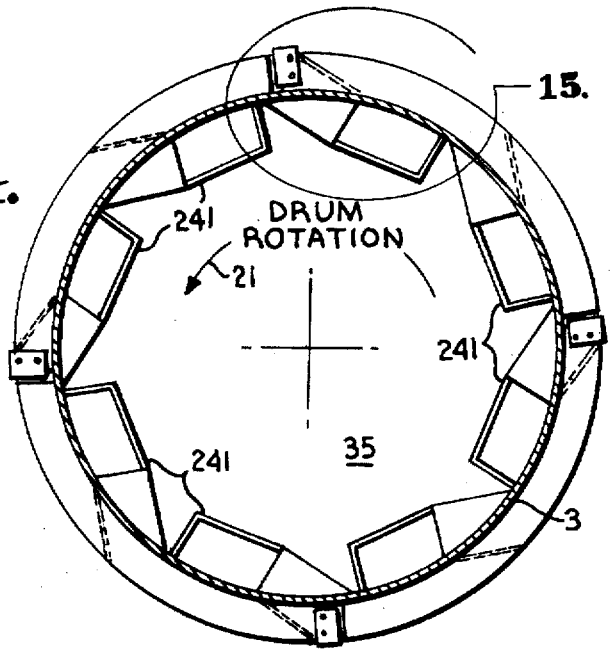
FIG. 14 is a further enlarged and fragmentary, schematic representation of a cross-section of the system for concurrently remediating contaminated soil and producing hot mix asphalt, showing the recycle asphalt input feed assembly, taken along line 14—14 in FIG. 1.

The scoops 241 open downwardly as the scoops 241 receive recycle asphalt material from the collar 233 as the drum 3 rotates, as indicated by the arrow 21 in FIG. 14, and deposit the recycle asphalt material near the wall 17 in the isolated mixing zone 49, to be mixed and processed with the other materials therein. Thermal energy from the heated aggregate and remediated soil transferred to the mixing zone 49 from the combustion zone 125 is transferred to the recycle asphalt material and other components added to the mixing zone 49, such as liquid asphalt, mineral frees, etc., for producing hot mix asphalt. The recycle asphalt input feed assembly 231 is spaced and the other constituents are added near the upstream end of the mixing zone 49 such that each can be thoroughly processed and mixed to produce hot mix asphalt sufficiently in advance of being discharged through the discharge chute 85.

In an application of the present invention, air from the blower 93 and fuel from the fuel piping 97 are forced through the burner head 46, generating a radiant flame 101 directed into the combustion zone 125. The flame 101 and forced air from the blower 93 causes a hot gas stream to be directed upstream from the burner head 43. In addition to other benefits, containing the blower head 43 well within the confines of the cavity 35 substantially reduces noise pollution in the area surrounding the drum 3. The hot gas stream generated by the flame at the burner head 43 flows from the burner head 43 upstream through the cavity 35 toward the input end 31 of the drum 3. The gas stream and any dust particles which may be entrained therein pass through the exhaust duct 71 to air pollution control equipment, such as a baghouse, where the dust is removed from the exhausted gas by fabric filtration or other suitable means.

Virgin aggregate is introduced by the material conveyor 65 into the drying zone 123 of the cavity 35 as the drum 3 is rotated by the drive rollers 11. The inclined orientation of the drum 3 causes the virgin aggregate to move downstream 47 successively through the drying zone 123, the combustion zone 125 and the mixing zone 49.

As the virgin aggregate is gravitationally urged through the drying zone 123, the bucket flights 131 lift and drop the virgin aggregate to create a curtain of falling aggregate across the interior of the drum 3 such that the virgin aggregate is dried and heated to an elevated temperature by the hot gas stream flowing therethrough. The heated and dried virgin aggregate is delivered from the drying zone 123 to the combustion zone 125.

The combustion flights 151 in the combustion zone 125 largely confine the virgin aggregate to the floor and lower sides of the wall 17 of the drum 3 to ensure that the flame 101 is not extinguished. The virgin aggregate, however, is still exposed to the radiant heat flux of the flame 101, but the design of the combustion flights 155 prevents discharge of the virgin aggregate directly through the visible portion of the flame 101

Contaminated soil is delivered through the feed hopper 179, the collar 177 encircling the drum 3, the wall openings 199, and the scoops 191 into the cavity 35 where the contaminated soil is deposited on top of the heated virgin aggregate. Volatile contaminants and moisture are vaporized from the contaminated soil as the contaminated soil is tumbled and mined across the surface of the heated virgin aggregate through manipulation of the virgin aggregate and the contaminated soil by the low-profile combustion flights 151. Volatile contaminants being vaporized from the contaminated soil are vaporized by conductive heat transfer from the heated virgin aggregate, by radiative heat transfer from the flame 101, and by convective heat transfer from the hot gas stream. As the volatile contaminants being vaporized from the contaminated soil are so vaporized, those vaporized contaminants are oxidized by the flame 101 and by the hot gas stream passing through the combustion zone 125 to the exhaust duct 71. Thermal energy released from such oxidation is available for assisting with oxidation of other vaporized contaminants and/or heating and drying virgin aggregate upstream therefrom.

After exiting from the combustion zone 125, the heated aggregate and soil, now remediated, enter the mixing zone 49. Recycle asphalt material is delivered through the feed hopper 235, the collar 233 encircling the drum 3, the wall openings 253, and the scoops 241 into the cavity 35 as hereinbefore described. It should be recalled that the mixing zone 49 is isolated by the interrelated and cooperating arrangement of various components and features of the system 1 as hereinbefore described wherein the thermal energy effectively available for producing hot mix asphalt in the mixing zone 49 is substantially available only from the thermal energy contained internally within the materials delivered into the mixing zone 49.

The virgin aggregate, remediated soil and recycle asphalt material are mixed and stirred by the low-profile flights in the mixing zone 49. Dust binder or mineral frees and/or reclaimed particulate matter are delivered into the mixing zone 49 by the screw conveyor 171 or other similar arrangement while liquid asphalt is sprayed into the mixing zone 49 by the injection tube 173. The aggregate, recycle asphalt material, binder, liquid asphalt and remediated soil, after being combined to form a desired hot mix asphaltic composition, are directed to the discharge chute 85. The final asphaltic product may be held in temporary storage facilities or delivered to a transport vehicle for use in pavement construction.

In short, transit time of the virgin aggregate is designed whereby thermal energy absorbed by and stored in the virgin aggregate in the drying zone 123 in combination with additional heating acquired en route through the combustion zone 125, is sufficient to volatilize contaminants and moisture from the contaminated soil introduced in the combustion zone 125 and, further, to process the recycle material together with the other constituents introduced into the mixing zone 49 to produce quality hot mix asphalt having a desired design mix. Heat output from the burner head 43 may be monitored and adjusted to respond to changes in material characteristics and feed ratios of the virgin aggregate, the contaminated soil and the recycle asphalt material.

It is to be understood that for any particular application, hot mix asphalt produced by the system 1 may include or not include recycle asphalt material, as desired. Similarly, hot mix asphalt produced by the system may include or not include remediated soil for any particular application, as desired.

Generally, for those applications Using remediated soil, the ratio of remediated soil to the remainder of the constituents of hot mix asphalt produced by the system 1 is a relatively small percentage, up to five to seven percent for example, depending on the application for which the hot mix asphalt is to be used.

It is to be understood that the greater the percentage of recycle asphalt used to produce the hot mix asphalt, the higher the temperature of the virgin aggregate exiting from the combustion zone 125 and entering the mixing zone 49 in order to properly process the recycle asphalt material. As a result, the greater the percentage of recycle asphalt, the more thorough the remediation of contaminants contained in the contaminated soil being processed by the system 1.

For example, if hot mix asphalt is to be produced without recycle asphalt material, the temperature of the dried and heated virgin aggregate as it exits the drying zone 123 and enters the combustion zone 125 may have a temperature range of 150°–300° F. The temperature of that virgin aggregate as it progresses through the combustion zone 125 will increase approximately another 100° F. Thus, the temperature of the virgin aggregate and the remediated soil as it exits the combustion zone 125 and enters the mixing zone 49 may have a temperature range of approximately 250°–350° F.

The increase in temperature acquired in a particular zone of the system 1 is, as known by those having skill in the art, dependant upon a variety of factors, such as the speed of rotation of the drum 3, the magnitude of the incline of the drum 3, the quantities of materials added to that zone and preceding zones, the thermal output of the burner assembly 41, the ambient temperature, etc.

If hot mix asphalt is to be produced with recycle asphalt material, the temperature of the dried and heated virgin aggregate as it enters the mixing zone 49 depends on the ratio of recycle asphalt material to the remainder of the constituents used for producing the hot mix asphalt. Generally, the ratio of recycle asphalt material may range up to fifty percent thereof, depending on the availability of recycle asphalt materials and the application for which the hot mix asphalt is to be used. For example, if a hot mix asphalt application uses fifty percent recycle asphalt materials, the virgin aggregate as it exits the drying zone 123 and enters the combustion zone 125 may have a temperature range of approximately 350°–450° F., which may increase approximately another 200 ° F. as it progresses through the combustion zone 125. Thus, the temperature of the virgin aggregate and the remediated soil as they exit the combustion zone 125 and enters the mixing zone 49 may have a temperature of approximately 650° F. to provide the thermal energy needed to process the recycle asphalt materials in the mixing zone 49.

Virgin aggregate may acquire even higher temperatures in the combustion zone 125, if desired, such as up to 800° F. for more thoroughly remediating soil in the combustion zone 125, or for remediating soil contaminated with contaminants having lower vaporization pressures such as diesel fuel, etc. In that event, various of the flightings would generally be constructed of materials that are more capable of withstanding the higher temperatures, such as stainless steel or other suitable material.

It is to be understood that while certain forms of the present invention have been illustrated and described herein, it is not to be limited to the specific forms or arrangement of parts described and shown.

What is claimed and desired to be secured by Letters Patent is as follows:

1. A system for concurrently remediating contaminated soil and producing hot mix asphalt from various constituents including virgin aggregate, the system comprising:

a) a single inclined drum having an input end, a discharge end, and a cavity extending between said input end and said discharge end;

b) support means for rotatably supporting said drum, said support means including drive means for rotatably driving said drum about a substantially horizontal axis of said drum and further including stationary upstream and downstream portions for respectively and rotatably receiving said input end and said discharge end of said drum;

c) a burner assembly extending within said cavity from said downstream portion of said support means; said burner assembly including a burner head spaced generally intermediately between said input end and said discharge end wherein said burner head is oriented such that a flame and hot gas stream therefrom are directed upstream from said burner head toward said input end;

(d) a secondary air tube extending within said cavity from said downstream portion of said support means such that atmospheric air is provided to said burner head for supporting combustion thereat;

e) a heating zone spaced within said cavity upstream from said burner head wherein said heating zone includes:

1) a drying zone spaced adjacently to, and extending axially inwardly from, said input end wherein said drying zone has a plurality of veiling flights configured to operatively create a falling curtain of the virgin aggregate as the virgin aggregate is lifted and dropped by said veiling flights, and 2) a combustion zone extending from said drying zone to said burner head wherein said combustion zone has a plurality of low-profile flights configured to operatively maintain materials being processed therethrough near lower extremities thereof;

f) a mixing zone spaced within said cavity downstream from said burner head;

g) aggregate input means for introducing the virgin aggregate into said heating zone, wherein said aggregate input means introduces the virgin aggregate into said drying zone near said input end of said drum;

h) soil input means for introducing contaminated soil into said heating zone; and i) asphalt input means for introducing certain of the various constituents into said mixing zone for producing the hot mix asphalt.

2. The system according to claim 1, wherein said soil input means is configured to introduce the contaminated soil into said combustion zone.

3. The system according to claim 2, wherein the contaminated soil is introduced into said combustion zone such that substantially all volatile contaminants being vaporized from the contaminated soil are substantially vaporized prior to exiting of the soil from said combustion zone.

4. The system according to claim 2, wherein the contaminated soil is introduced into said combustion zone such that substantially all volatile contaminants being vaporized from the contaminated soil are substantially oxidized within said combustion zone.

5. The system according to claim 2, wherein the contaminated soil introduced into said combustion zone is deposited on top of the virgin aggregate being gravitationally urged through said combustion zone.

6. The system according to claim 5, including structural means for vaporizing substantially all moisture and volatile contaminants from the contaminated soil as rotation of the drum causes the contaminated soil to tumble across upper extremities of the virgin aggregate being gravitationally urged through said combustion zone.

7. The system according to claim 5, including structural means for vaporizing the volatile contaminants from the contaminated soil by conductive heat transfer from the virgin aggregate, by radiative heat transfer from a flame from said burner head, and by convective heat transfer from a hot gas stream from said burner head.

8. A system for concurrently remediating contaminated soil and producing hot mix asphalt from various constituents including virgin aggregate, the system comprising:

a) a single inclined drum having an input end, a discharge end, and a cavity extending between said input end and said discharge end;

b) support means for rotatably supporting said drum, said support means including drive means for rotatably driving said drum about a substantially horizontal axis of said drum and further including stationary upstream and downstream portions for respectively and rotatably receiving said input end and said discharge end of said drum;

c) a burner assembly extending within said cavity from said downstream portion of said support means; said burner assembly including a burner head spaced generally intermediately between said input end and said discharge end wherein said burner head is oriented such that a time and hot gas stream therefrom are directed upstream from said burner head toward said input end;

(d) a secondary air tube extending within said cavity from said downstream portion of said support means such that atmospheric air is provided to said burner head for supporting combustion thereat;

e) a heating zone spaced within said cavity upstream from said burner head;

f) a mixing zone spaced within said cavity downstream from said burner head;

g) aggregate input means for introducing the virgin aggregate into said heating zone;

h) soil input means for introducing contaminated soil into said heating zone;

i) asphalt input means for introducing certain of the various constituents into said mixing zone for producing the hot mix asphalt; and j) isolating means for isolating said mixing zone, said isolating means including:

1) said stationary downstream portion sealingly receiving said discharge end of said drum such that gas flow through said mixing zone is substantially eliminated, 2) said secondary air tube being spaced apart from said burner assembly and being substantially longitudinally coextensive with said burner assembly within said cavity, and 3) a cowling extending longitudinally inwardly and radially outwardly from said secondary air tube.

9. The system according to claim 8, wherein said isolating means further includes means for isolating said mixing zone and materials being processed in said mixing zone from substantially all heat transfer thereto, except for heat transfer arising from thermal energy contained internally within those materials as those materials are introduced into said mixing zone.

* * * * *